US006508748B1

(12) United States Patent
Ish, III

(10) Patent No.: US 6,508,748 B1
(45) Date of Patent: Jan. 21, 2003

(54) ACTUATOR ASSEMBLIES FOR ADJUSTMENT MECHANISMS OF EXERCISE MACHINES

(75) Inventor: A. Buell Ish, III, Redmond, WA (US)

(73) Assignee: Vectra Fitness, Inc., Kent, WA (US)

( * ) Notice: Subject to any disclaimer, the term of this patent is extended or adjusted under 35 U.S.C. 154(b) by 0 days.

(21) Appl. No.: 09/498,697

(22) Filed: Feb. 7, 2000

(51) Int. Cl.[7] ..... A63B 21/00
(52) U.S. Cl. ..... 482/100; 482/9; 482/98
(58) Field of Search ..... 74/500.5, 84, 501.6, 74/501.5 R, 505, 506; 482/102–106, 98, 97, 99, 100

(56) References Cited

U.S. PATENT DOCUMENTS 486,718 A * 11/1892 Kelley
1,614,419 A * 1/1927 Brewster
4,699,018 A * 10/1987 Tagawa
4,708,004 A * 11/1987 Allen
6,047,614 A * 4/2000 Beugelsdyk

* cited by examiner

*Primary Examiner*—Jerome W. Donnelly
(74) *Attorney, Agent, or Firm*—Dorsey & Whitney LLP

(57) ABSTRACT

Actuator assemblies for adjustment mechanisms of exercise machines. In one embodiment, an actuator assembly includes a connecting member having a first end attached to the adjustment mechanism and a second end, a shaft rotatably coupled to the exercise machine proximate the second end, an actuating handle attached to the shaft, and a coupling member attached to the second end of the connecting member and having an engagement portion contacting an actuating portion of the shaft. As the shaft is rotated, the actuating portion of the shaft pushes the engagement portion of the coupling member, tensioning the connecting member and actuating the adjustment mechanism. The actuator mechanism advantageously reduces wear and breakage of the connecting member. In another embodiment, the shaft may be rotated in either a forward or an aft direction, improving the convenience of the actuator assembly for the user.

59 Claims, 6 Drawing Sheets

ACTUATOR ASSEMBLIES FOR ADJUSTMENT MECHANISMS OF EXERCISE MACHINES

TECHNICAL FIELD

The present invention relates to actuator assemblies for adjustment mechanisms of exercise machines.

BACKGROUND OF THE INVENTION

The convenience, efficiency, and safety of weight-training exercise machines is widely recognized. Popular weight-training exercise machines feature multiple stations at which a user may perform a variety of exercises for developing and toning different muscle groups. For example, an exercise machine may include a "press" station for exercising the chest and shoulders, a leg station for exercising the legs, and a pull-down station for exercising the arms and upper body. Typical exercise machines include a weight stack that can provide a variable load. The user simply adjusts the position of a pin to attach a desired number of lifted plates to a lift arm to achieve a desired training load.

FIG. 1 is an elevational view of an exercise machine 100 having a weight stack 102 and a press station 104. The press station 104 includes a lift arm 106 having a pair of handles 108. In operation, a user 110 may perform a press exercise by lying on a bench 111 and grasping the handles 108. The user then applies a training force to the handles 108, pressing the handles 108 upwardly away from the user's chest. As the user 110 overcomes the gravitational force on the lifted plates, the handles 108 move upwardly.

Prior to performing the press exercise, the user 110 may adjust the position of the lift arm 106 to a desirable initial position. FIG. 2 is an enlarged partial isometric view of a press handle 108 and an actuator assembly 120 of the exercise machine 100 of FIG. 1. The actuator assembly 120 includes a gripper handle 122 pivotably attached to the lift arm near the press handle 108 by a pivot pin 126. A cable 124 is attached at a first end to the gripper handle 122. From the gripper handle 122, the cable 126 enters the interior of the lift arm 106, turns through a 90-degree turn 128 about a cable guide 127, and extends through the interior of the lift arm to an adjustment mechanism (not shown). The adjustment mechanism is attached to a base portion of the lift arm 106. When the user 110 depresses the gripper handle 122 in a downward direction 130 toward the press handle 108, the cable 124 is drawn upwardly and partially out of the interior of the lift arm 106. The adjustment mechanism is disengaged, freeing the lift arm 106 to be pivoted about the base portion into the desired position. Exercise machines 100 of the type shown in FIGS. 1 and 2 are commercially available.

The actuator assembly 120 has several disadvantages. For example, the cable 124 is prone to excessive wear and breakage. Because the cable 124 is wrapped about the cable guide 127 and turns through the 90 degree turn 128, considerable frictional forces are exerted on the cable 126 during actuation of the gripper handle 122. Over an extended period of time, the cable 126 is worn by the frictional forces and breaks. Also, because the gripper handle 122 only actuates in the downward direction 130, the gripper handle 122 is not easily actuated during some exercises that the user may perform using the press station 104. For example, when the user 110 stands facing the weight stack 102 with the lift arm 106 in a lowered position to perform a "shrug" exercise, the gripper handle 122 is not conveniently positioned for actuation, making it difficult for the user 110 to adjust the lift arm 106 to the desired position.

SUMMARY OF THE INVENTION

The present invention is directed to actuator assemblies for adjustment mechanisms of exercise machines. In one aspect, an actuator assembly includes a cable having a first end attached to the adjustment mechanism and a second end, a shaft rotatably coupled to the exercise machine proximate the second end, an actuating handle attached to the shaft, and a coupling member attached to the second end of the cable and engaged with the shaft. As the shaft is rotated, an actuating portion of the shaft pushes an engagement portion of the coupling member, tensioning the cable and actuating the adjustment mechanism. The actuator mechanism advantageously reduces wear and breakage of the cable. In another aspect, the shaft may be rotated in either a forward or an aft direction, improving the convenience of the actuator assembly for the user.

DETAILED DESCRIPTION OF THE INVENTION

The present invention is generally directed to actuator assemblies for adjustment mechanisms of exercise machines. Many specific details of certain embodiments of the invention are set forth in the following description and in FIGS. 3–11 to provide a thorough understanding of such embodiments. One skilled in the art will understand, however, that the present invention may have additional embodiments, and that the present invention may be practiced without several of the details described in the following description.

Figure 3:
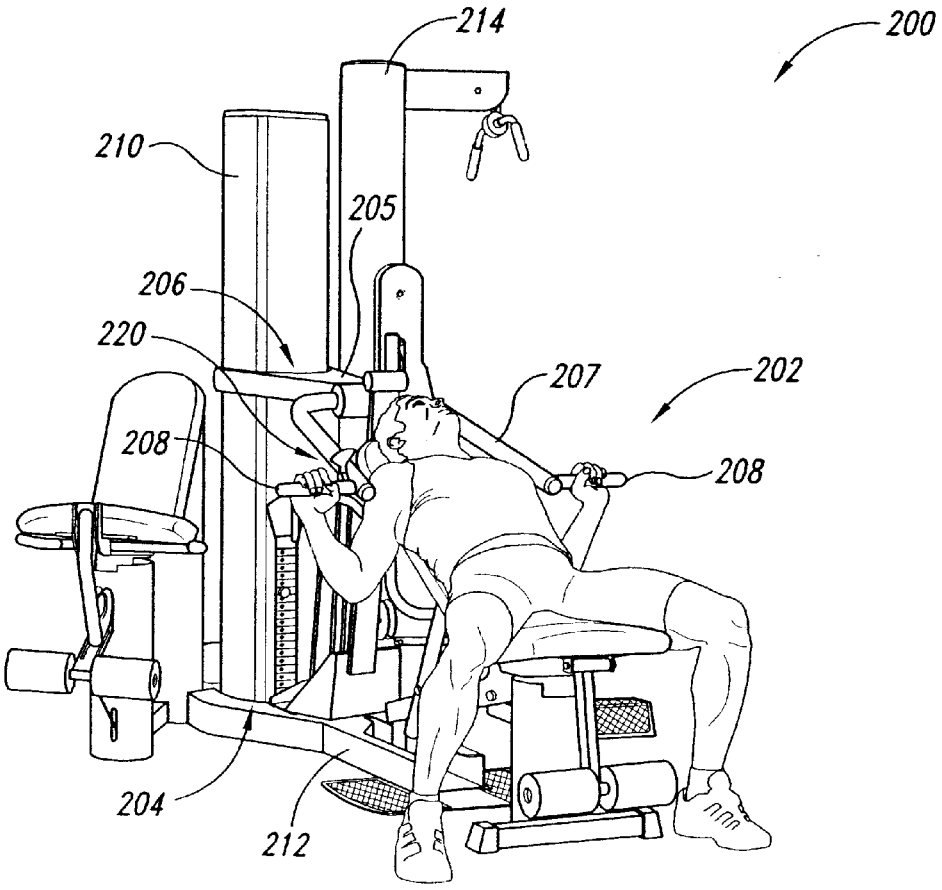
FIG. 3 is an isometric view of an exercise machine in accordance with an embodiment of the invention.

FIG. 3 is an isometric view of an exercise machine 200 in accordance with an embodiment of the invention. The exercise machine 200 includes a press station 202 and a weight guide 210 having a weight stack 204 positioned therein. An adjustable lift arm 206 includes a support portion 205 pivotably coupled to the weight guide 210 and is operatively coupled to the weight stack 204 by a cable-and-pulley device 212. The lift arm 206 also includes a handle bar 207 pivotably coupled to the support portion 205. The handle bar 207 has a pair of handles 208 that may be grasped by a user 110 to perform a variety of press exercises.

Figure 4:
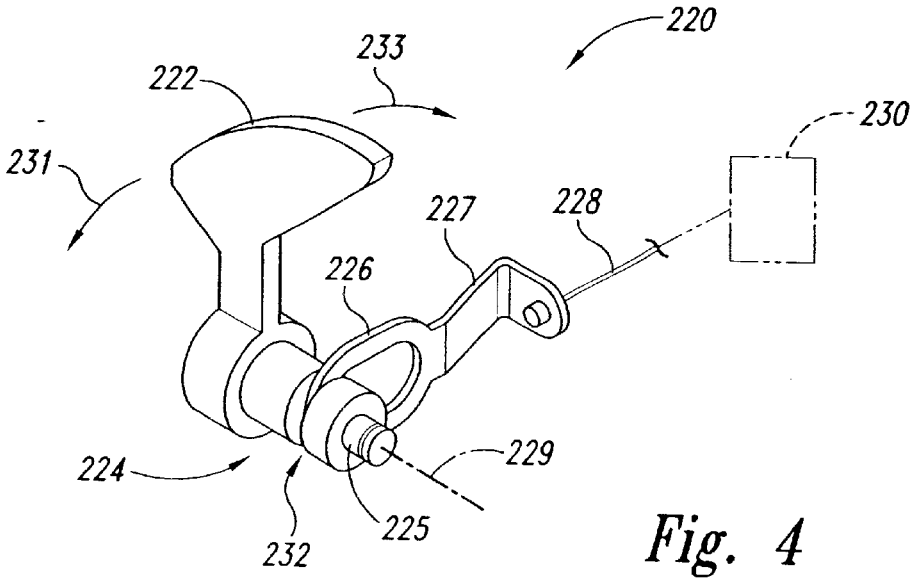
FIG. 4 is an isometric view of an actuator assembly in accordance with an embodiment of the invention.
Figure 5:
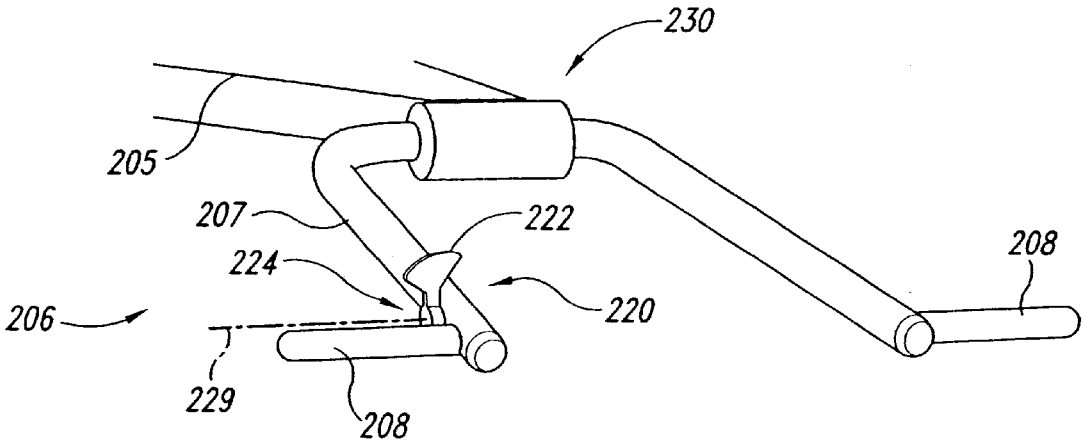
FIG. 5 is an isometric view of the actuator assembly of FIG. 4 assembled with a press arm of the exercise machine of FIG. 3.

FIG. 4 is an isometric view of an actuator assembly 220 in accordance with an embodiment of the invention. FIG. 5 is an isometric view of the actuator assembly 220 assembled with the press arm 206 of FIG. 3. As best shown in FIG. 4, the actuator assembly 220 includes a lever (or actuating handle) 222 attached to a shaft 224. The shaft 224 includes a support portion 225 and is rotatable about its axis 229 in forward and aft directions 231, 233. A coupling ring 226 is slipped onto the shaft 224, and a tab 227 extends from the coupling ring 226. An actuator cable 228 has a first end attached to the tab 227 and a second end attached to a pivot arm adjustment mechanism 230, described more fully below.

Figure 6:
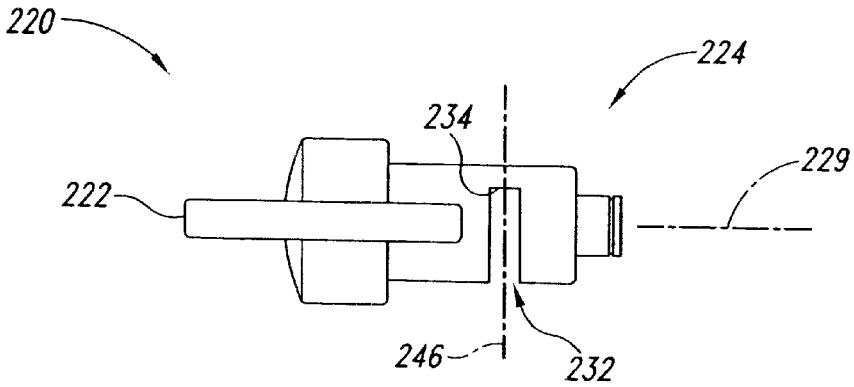
FIG. 6 is a top plan view of the lever and the shaft of the actuator assembly of FIG. 4.
Figure 7:
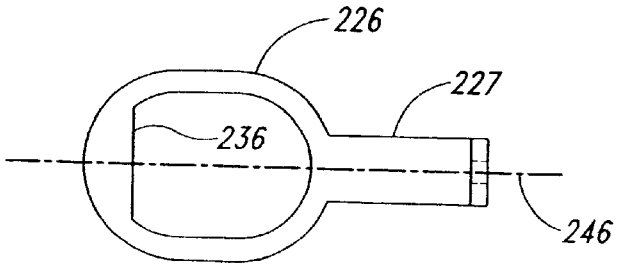
FIG. 7 is a front elevational view of a coupler of the actuator assembly of FIG. 4.

FIG. 6 is a top plan view of the lever 222 and the shaft 224 of the actuator assembly 220 of FIG. 4. FIG. 7 is a front elevational view of the coupling ring 226 of the actuator assembly 220 of FIG. 4. As best seen in FIG. 6, the shaft 224 has a notch 232 formed therein. The notch 232 has a bottom surface 234. As shown in FIG. 7, the coupling ring 226 includes an inner surface 236. When the coupling ring 226 is assembled with the shaft 224 (FIG. 4), the coupling ring 226 is seated within the notch 232 so that the inner surface 236 contacts the bottom surface 234.

Figure 8:
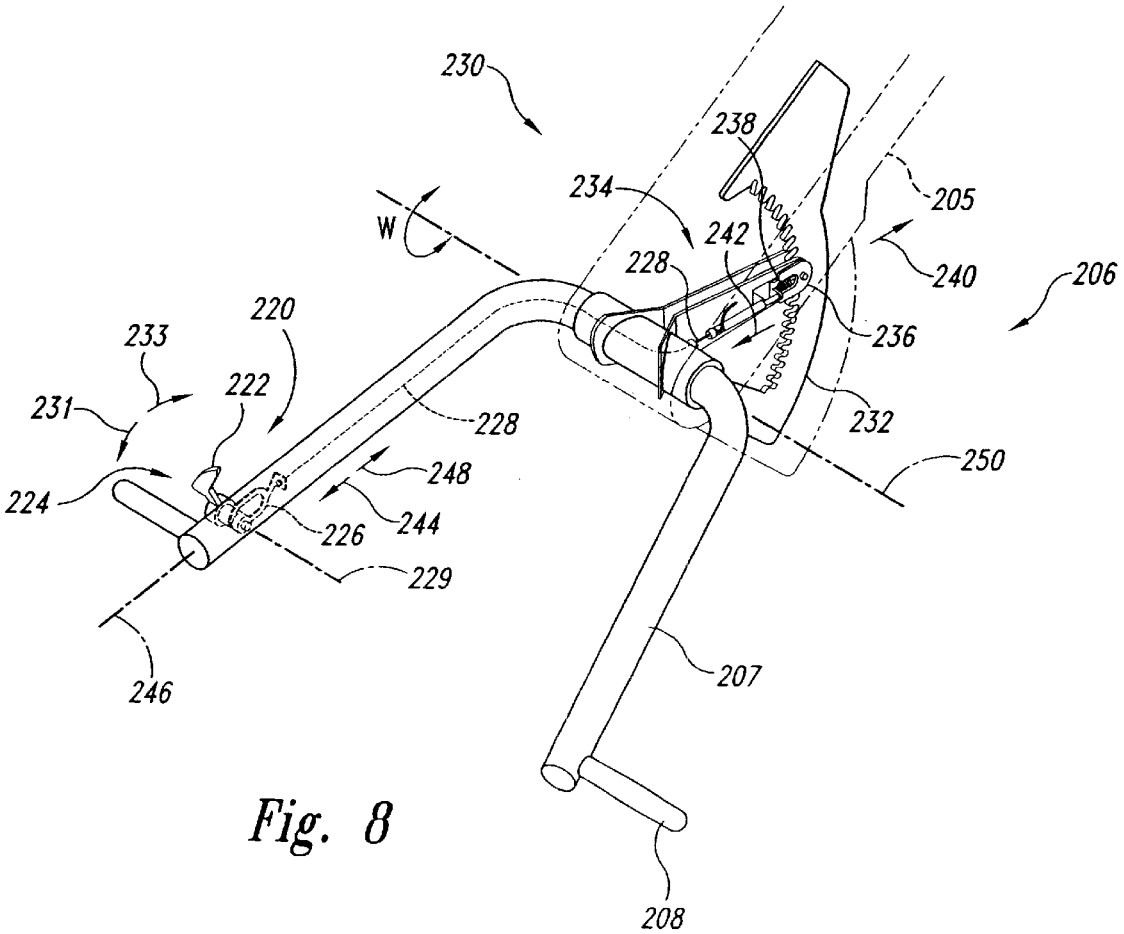
FIG. 8 is a front, partial isometric view of the lift arm and an adjustment mechanism of the exercise machine of FIG. 3.
Figure 9:
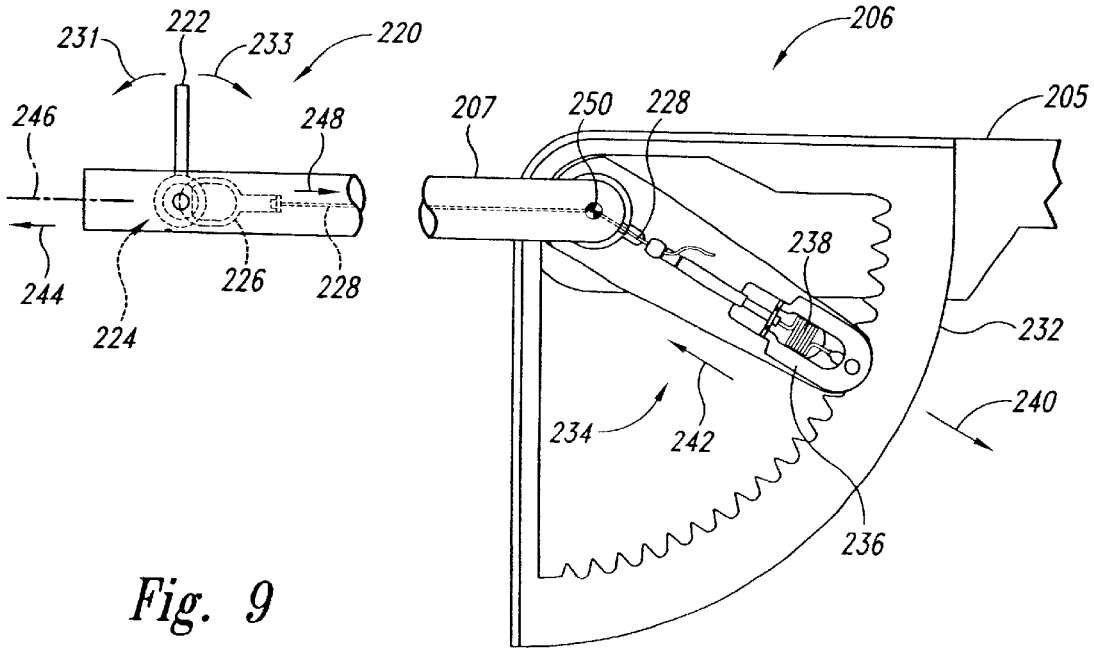
FIG. 9 is a back, partial isometric view of the lift arm and the adjustment mechanism of the exercise machine of FIG. 3.

FIGS. 8 and 9 are front and back partial isometric views, respectively, of the lift arm 206 and the adjustment mechanism 230 of the exercise machine 200 of FIG. 3. The adjustment mechanism 230 includes a toothed arch 232 affixed to the support portion 205 of the lift arm 206. An adjustment bracket 234 is attached to the handle bar 205 and is releaseably engageable with the toothed arch 232. The adjustment bracket 234 includes a slideably moveable locking member 236 and a biasing spring 238. The locking member 236 is moveable in an engagement direction 240 and a disengagement direction 242. The biasing spring 238 exerts a biasing force on the locking member 236, urging the locking member 236 in the engagement direction 240. The actuating cable 228 is attached to the locking member 236 such that actuation thereof moves the locking member 236 in the disengagement direction 242.

In operation, the user 110 moves the lever 222 of the actuating assembly 220 in either the forward or aft direction 231, 233, causing the shaft 224 to rotate. The bottom surface 234 of the notch 232 pushes against the inner surface 236 of the coupling ring 226, forcing the coupling ring 226 and the actuating cable 228 in a tensioning direction 244 along a longitudinal axis 246 of the cable 228 (see FIGS. 8 and 9). As the cable 228 is drawn in the tensioning direction 244, the locking member 236 is moved in the disengagement direction 242, releasing the adjustment bracket 234 from the toothed arch 232. The handle bar 207 may then be pivotably rotated W about a pivot axis 250 until the handles 208 are in the desired position.

After the handles 208 are moved into the desired position, the user 110 releases the lever 222. The biasing spring 238 urges the locking member 236 in the engagement direction 240, re-engaging the adjustment bracket 234 with the toothed arch 232 and locking the handle bar 207 in the desired position. The movement of the locking member 236 draws the actuating cable 228 and the coupling ring 236 in a re-engagement direction 248, rotating the shaft 224 and returning the lever 222 to its initial position.

The actuating assembly 220 advantageously provides the desired actuating capability using an assembly that is less prone to wear and breakage. Because the actuating cable 228 is pulled by the coupling ring 226 along its longitudinal axis 246, the cable 228 is subjected to less wear compared with the conventional actuating mechanism. The 90-degree turn and the cable guide of the prior art actuating mechanism are eliminated. Thus, because wear and breakage are reduced, the actuating assembly 220 reduces the down-time, cost and inconvenience of maintaining the exercise machine 200.

Figure 1:
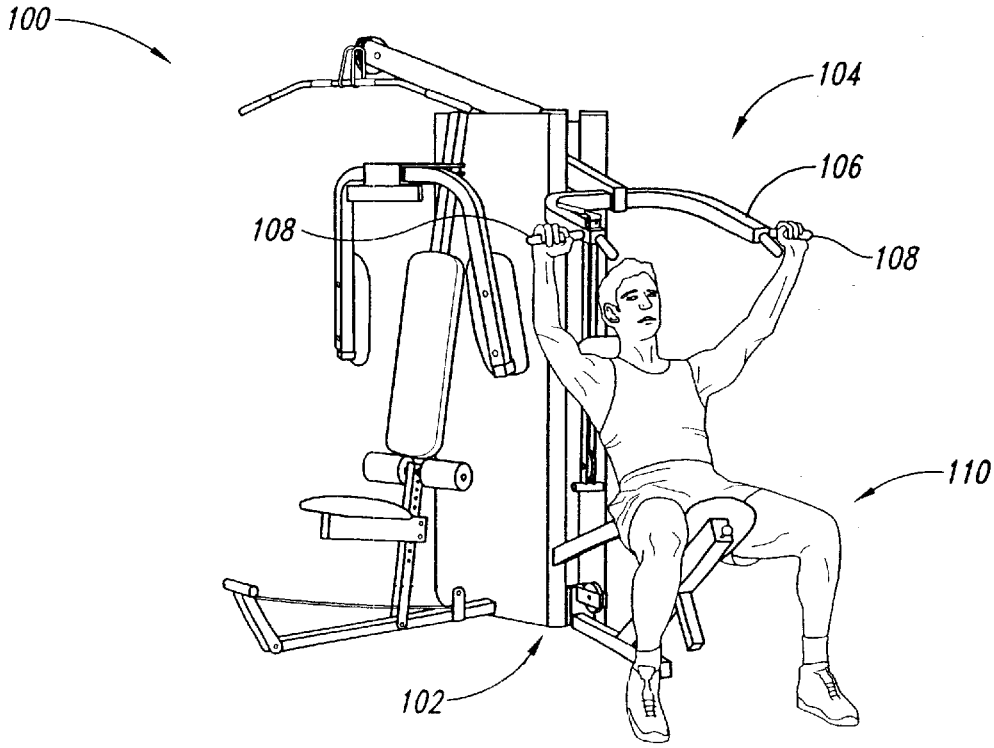
Fig. 1 (Prior Art)
FIG. 1 is an isometric view of an exercise machine in accordance with the prior art.
Figure 2:
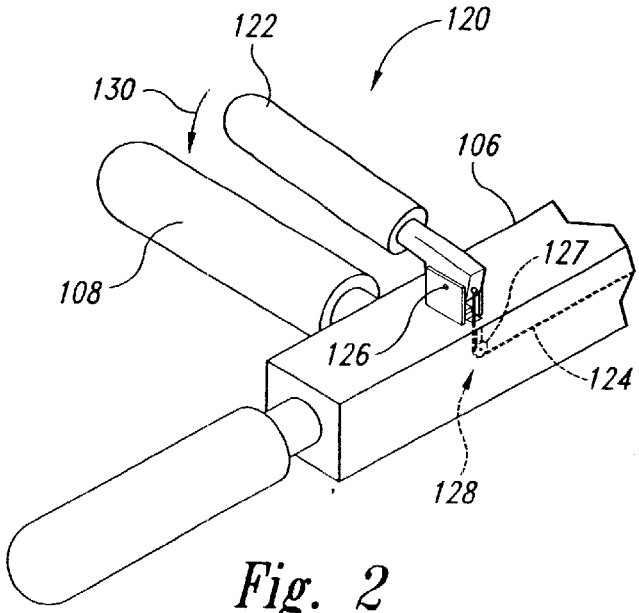
Fig. 2 (Prior Art)
FIG. 2 is an enlarged partial isometric view of a press handle and an actuator assembly of the exercise machine of FIG. 1.

Another advantage of the actuating assembly 220 is that the lever 222 may be moved in either the forward or aft directions 231, 233 to actuate the cable 228. Because the actuating assembly is bi-directional, the actuating assembly 220 may be more conveniently operated by the user. For example, if the user sits on a bench facing the weight stack and desires to move the handles 208 to approximately shoulder level for military presses, the user may simply toggle the lever 222 in the forward or aft direction 231, 233 to reposition the handles into the desired position. There is no need for the user to become contorted by attempting to grasp and squeeze a gripper handle 122 together with a press handle 108 as in the conventional actuating assembly (FIG. 2). Similarly, if the user stands facing the weight stack with the handles 208 at approximately the level of the user's waist, the lever 222 is more easily actuated in the forward or aft direction than is the gripper handle 122 of the prior art. Because the actuating assembly 220 is more conveniently actuated by the user from a variety of exercise positions, the user's satisfaction with the exercise machine is increased.

One may note that the actuating assembly 220 may be used with almost any type of cable-actuated adjustment mechanism, and is not limited to the particular embodiment of adjustment mechanism 230 shown in the accompanying figures and described above. For example, the actuating mechanism could be used to adjust an adjustment mechanism of a seat, or a back rest, or a leg pad, or any other component of an exercise machine. Thus, actuating assemblies in accordance with the present invention may be used in combination with any number of adjustment mechanisms, including those of numerous exercise machines presently on the market.

One may also note that several aspects of the actuating assembly 220 may be varied from the particular embodiment shown in the accompanying figures and described above. For example, the axis of rotation 229 of the shaft 224 need not be perpendicular to the longitudinal axis 246 of the actuating cable 228 as shown in the figures. It is also not essential that the axis of rotation 229 intersect the longitudinal axis 246.

Furthermore, although the longitudinal axis 246 is shown as passing perpendicularly through a center of the bottom surface 234 of the notch 232 (see FIGS. 6 and 7), this particular orientation is not essential. For example, the longitudinal axis 246 may intersect the bottom surface 234 at an off-center position, or it may not even intersect the bottom surface 234 at all. Also, the longitudinal axis 246 need not be perpendicular to the bottom surface 234, such as when the axis of rotation 229 is transverse with, but not perpendicular to, the longitudinal axis 246.

In addition, if the shaft 224 is constrained to rotate in only a single direction (i.e. the lever of the actuating assembly is unidirectional in either the forward direction 231 or the aft direction 233) the above-noted advantages of reduced wear and breakage and improved maintenance of the actuating cable 228 may still be achieved. Those of ordinary skill in the art will recognize that additional aspects of the above-described embodiment may be varied without departing from the scope and teachings of the invention.

Actuating assemblies in accordance with the invention may be used with a variety of connecting members other than cables. For example, the cable 228 may be replaced by a flexible connecting member, such as a wire, a cord, a band, a chain, or a belt. Alternately, such as when the actuating assembly 220 is aligned with the adjustment assembly 230 (i.e. there are no bends or turns in the connecting member), the cable 228 may be replaced by an inflexible member, such as a rod, or a linkage.

Figure 10:
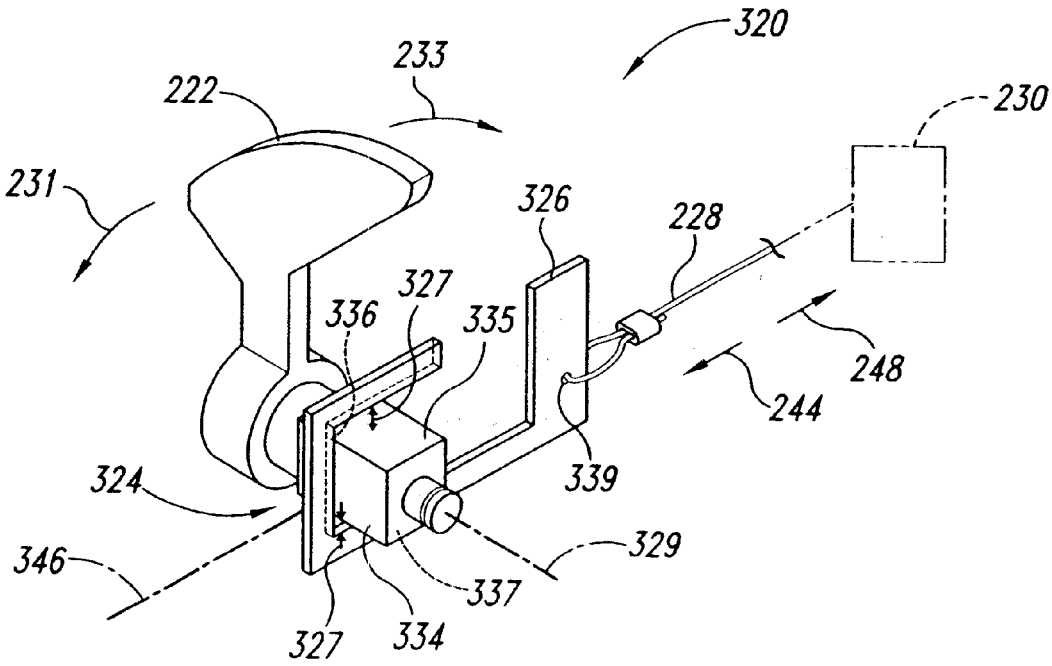
FIG. 10 is an isometric view of an actuator assembly in accordance with an alternate embodiment of the invention.

FIG. 10 is an isometric view of an actuator assembly 320 in accordance with an alternate embodiment of the invention. In this embodiment, the actuator assembly 320 includes a lever 222 attached to a rectangular shaft 324. A coupling hook 326 is slipped onto the rectangular shaft 324 and includes a coupling aperture 339. An actuating cable 228 is looped through the coupling aperture 339 to attach the actuating cable 228 to the coupling hook 326. Clearance spaces 327 exist between the coupling hook 324 and an upper and lower surface 335, 337 of the rectangular shaft 324, allowing clearance for the rectangular shaft 324 to rotate in both the forward and aft directions 231, 233 about an axis of rotation 329. An actuating surface 334 of the rectangular shaft 324 contacts an engagement surface 336 of the coupling hook 326. A longitudinal axis 346 of the actuating cable 228 projects through the actuating surface 334 and passes below the axis of rotation 329 of the rectangular shaft 324.

As described above, in operation, the lever 222 is moved in either the forward or aft direction 231, 233, rotating the rectangular shaft 324. The actuating surface 334 of the rectangular shaft 324 pushes against the engagement surface 336 of the coupling hook 326, drawing the actuating cable 228 in the tensioning direction 244 along the longitudinal axis 346 of the cable 228. The actuating cable 228 actuates the adjustment mechanism 230, enabling the user to adjust the handles 208 of the exercise machine into a desired position. Thus, the above-described benefits of reduced wear and breakage, improved maintenance, and improved convenience and user satisfaction are achieved.

It is apparent that a wide variety of shaft cross-sectional shapes may be used, and that the shaft is not limited to the circular or rectangular cross-sections shown in the accompanying figures and described above. For example, the shaft may have the cross-sectional shape of an ellipse, or a triangle, or any other suitable shape. Furthermore, it is not necessary that the shaft contact the engagement surface of the coupling member (coupling ring, coupling hook, etc.) over an entire engagement surface. The shaft may engage the engagement surface along an edge, or even at a single point location. Generally, the engagement portion of the shaft may be any suitable cam eccentrically mounted on the shaft, and the coupling member may be any suitable follower. Any number of suitable cam-and-follower arrangements are possible.

Figure 11:
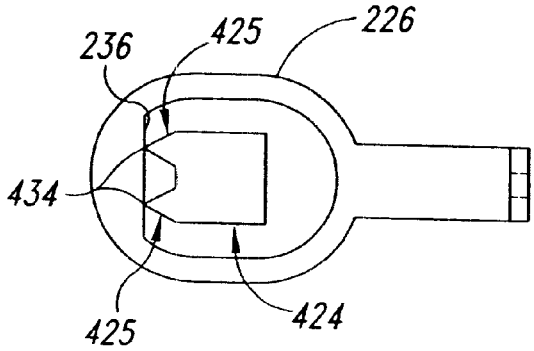
FIG. 11 is a cross-sectional view of a shaft and a coupling ring in accordance with an alternate embodiment of the invention.

FIG. 11 is a cross-sectional view of a shaft 424 and the coupling ring 226 in accordance with an alternate embodiment of the invention. The shaft 424 includes a pair of actuating projections 425 that contact the engagement surface 236 of the coupling ring 226. In one embodiment, the actuating projections 425 are wedge-shaped, and contact the engagement surface 236 along actuating edges 434. In an alternate embodiment, the actuating projections 425 are conical and contact the engagement surface 236 at actuating points 434. In further embodiments, the actuating projections may be disposed on the engagement surface of the coupling member rather than on the shaft. In still further embodiments, such as for a unidirectional actuating assembly, one of the actuating projections 425 may be eliminated, such that the shaft engages the engagement surface of the coupling member along a single actuating edge, or even at a single actuating point.

Figure 12:
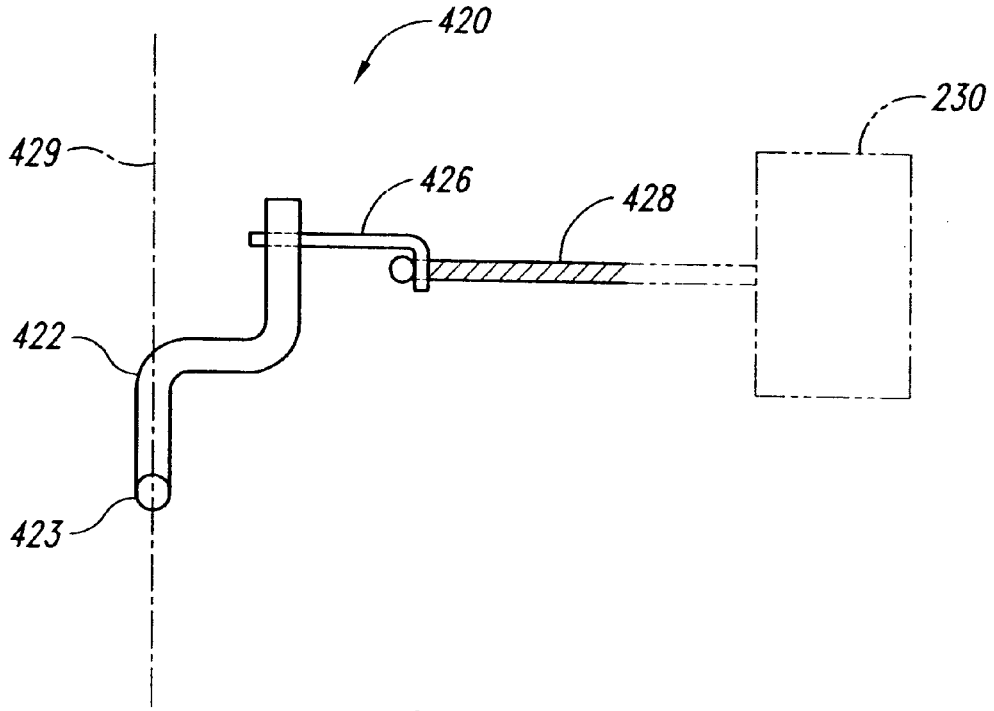
FIG. 12 is a top plan view an actuating assembly in accordance with another embodiment of the invention.
Figure 13:
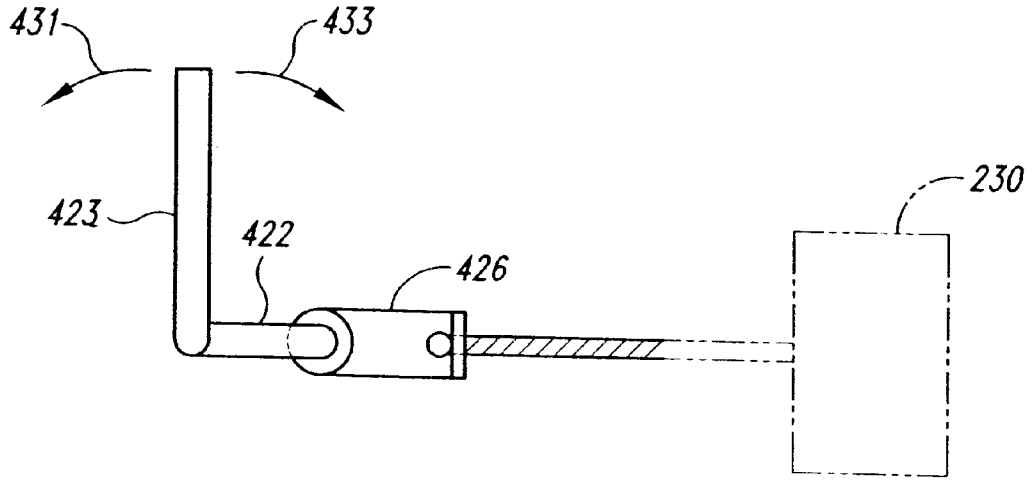
FIG. 13 is a side elevational view the actuating assembly of FIG. 12.

FIG. 12 is a top plan view an actuating assembly 420 in accordance with another embodiment of the invention. FIG. 13 is a side elevational view the actuating assembly 420 of FIG. 12. In this embodiment, the actuating assembly 420 includes a crank 422 having a handle 423. A follower 426 is disposed about the crank 422. A connecting member 428 is coupled to the follower 426 and to the adjustment mechanism 230. The crank 422 is rotatable about a rotation axis 429 (FIG. 12) in forward and aft directions 431, 433. In operation, the crank 422 may be rotated by applying a force on the handle 423 in the forward or aft direction 431, 433. The crank 422 pulls the follower 426 and the connecting member 428 at least partially along the longitudinal axis of the connecting member 428, tensioning the connecting member 428 and actuating the adjustment mechanism 230.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other actuator assemblies for adjustment mechanisms of exercise machines, and not just to the embodiments described above and shown in the accompanying figures. Accordingly, the scope of the invention should be determined from the following claims.

What is claimed is:

1. An actuating assembly for actuating an adjustment mechanism in an exercise machine, comprising:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a cylindrical shaft having a notch disposed therein, the engagement portion comprising a bottom surface of the notch.

2. The assembly of claim 1 wherein the shaft comprises a rectangular cross-sectional shaft, the engagement portion comprising a surface of the rectangular cross-sectional shaft.

3. The assembly of claim 1 wherein the actuating portion comprises an actuating edge.

4. The assembly of claim 1 wherein the connecting member comprises a cable.

5. The assembly of claim 1 wherein the axis of rotation is perpendicular to the longitudinal axis.

6. The assembly of claim 1 wherein the axis of rotation intersects the longitudinal axis.

7. The assembly of claim 1 wherein the actuating portion comprises an actuating surface, the longitudinal axis being perpendicular to the actuating surface.

8. The assembly of claim 1 wherein the actuating portion comprises an actuating surface, the longitudinal axis intersecting the actuating surface.

9. The assembly of claim 1 wherein the actuating handle comprises a lever projecting in an at least partially radial direction from the shaft.

10. The assembly of claim 1 wherein the coupling member comprises a coupling ring.

11. The assembly of claim 1 wherein the coupling member comprises a coupling hook.

12. An actuating assembly for actuating an adjustment mechanism in an exercise machine, comprising:

shaft rotatably mounted for access by a user of the exercise machine, the shaft having an eccentric portion;

a lever connected to the shaft for transmitting a rotational force thereto;

a follower engageable with the eccentric portion and moveable between first and second positions in response to rotation of the eccentric portion; and a connecting member extending between the follower and the adjustment mechanism for transmitting a force therebetween.

13. The actuating assembly of claim 12 wherein the connecting member comprises a cable.

14. The actuating assembly of claim 12 wherein the eccentric portion comprises a notched cylindrical portion.

15. The actuating assembly of claim 12 wherein the follower comprises a coupling ring.

16. An actuating assembly for actuating an adjustment mechanism in an exercise machine, comprising:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a rectangular cross-sectional shaft, the engagement portion comprising a surface of the rectangular cross-sectional shaft.

17. The assembly of claim 16 wherein the shaft is rotatable in a forward direction and in an aft direction.

18. The assembly of claim 16 wherein the actuating portion comprises an actuating edge.

19. The assembly of claim 16 wherein the connecting member comprises a cable.

20. The assembly of claim 16 wherein the axis of rotation is perpendicular to the longitudinal axis.

21. The assembly of claim 16 wherein the axis of rotation intersects the longitudinal axis.

22. The assembly of claim 16 wherein the actuating portion comprises an actuating surface, the longitudinal axis being perpendicular to the actuating surface.

23. The assembly of claim 16 wherein the actuating handle comprises a lever projecting in an at least partially radial direction from the shaft.

24. An adjustment assembly for adjusting a position of a component of an exercise machine, comprising:

an adjustment mechanism coupled to the component and having a locking member releasably engageable with a fixed member, the component being moveable when the locking member is disengaged from the fixed member; and an actuating assembly including:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a rectangular cross-sectional shaft, the engagement portion comprising a surface of the rectangular cross-sectional shaft.

25. The assembly of claim 24 wherein the connecting member comprises a cable.

26. The assembly of claim 24 wherein the coupling member comprises a coupling ring.

27. The assembly of claim 24 wherein the component comprises a handle bar.

28. The assembly of claims 24 wherein the exercise machine comprises a weight lifting machine.

29. An exercise machine, comprising:

an adjustably positionable component;

a load operatively coupled to the component;

an adjustment mechanism coupled to the component and having a locking member releasably engageable with a fixed member, the component being moveable when the locking member is disengaged from the fixed member; and an actuating assembly including:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a rectangular cross-sectional shaft, the engagement portion comprising a surface of the rectangular cross-sectional shaft.

30. The exercise machine of claim 29 wherein the connecting member comprises a cable.

31. The exercise machine of claim 29 wherein the coupling member comprises a coupling ring.

32. The exercise machine of claims 29 wherein the component comprises a handle bar.

33. The exercise machine of claim 29 wherein the load is operatively coupled to the component by a cable-and-pulley device.

34. The exercise machine of claim 29 wherein the load comprises a weight stack.

35. An adjustment assembly for adjusting a position of a component of an exercise machine, comprising:

an adjustment mechanism coupled to the component and having a locking member releasably engageable with a fixed member, the component being moveable when the locking member is disengaged from the fixed member; and an actuating assembly including:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a cylindrical shaft having a notch disposed therein, the engagement portion comprising a bottom surface of the notch.

36. The assembly of claim 35 wherein the connecting member comprises a cable.

37. The assembly of claim 35 wherein the coupling member comprises a coupling ring.

38. The assembly of claim 35 wherein the component comprises a handle bar.

39. The assembly of claim 35 wherein the exercise machine comprises a weight lifting machine.

40. An exercise machine, comprising:

an adjustably positionable component;

a load operatively coupled to the component;

an adjustment mechanism coupled to the component and having a locking member releasably engageable with a fixed member, the component being moveable when the locking member is disengaged from the fixed member; and an actuating assembly including:

a connecting member having a first end attached to the adjustment mechanism and a second end having a longitudinal axis;

a shaft rotatably coupled to the exercise machine proximate the second end, the shaft being rotatable about an axis of rotation and having an actuating portion, the axis of rotation being transverse with the longitudinal axis;

an actuating handle attached to the shaft; and a coupling member attached to the second end of the connecting member and having an engagement portion at least partially contacting the actuating portion so that as the shaft is rotated, the actuating portion engages the engagement portion and moves the coupling member at least partially along the longitudinal axis, wherein the shaft comprises a cylindrical shaft having a notch disposed therein, the engagement portion comprising a bottom surface of the notch.

41. The exercise machine of claim 40 wherein the connecting member comprises a cable.

42. The exercise machine of claim 40 wherein the coupling member comprises a coupling ring.

43. The exercise machine of claim 40 wherein the component comprises a handle bar.

44. The exercise machine of claim 40 wherein the load is operatively coupled to the component by a cable-and-pulley device.

45. The exercise machine of claim 40 wherein the load comprises a weight stack.

46. An adjustment assembly for adjusting a position of a component of an exercise machine, comprising:

an adjustment mechanism coupled to the component and having a locking member releasably engageable with a fixed member, the component being moveable when the locking member is disengaged from the fixed member; and an actuating assembly including:

a shaft rotatably mounted to a portion of the exercise machine for access by a user of the exercise machine, the shaft having an eccentric portion;

a lever connected to the shaft for transmitting a rotational force thereto;

a follower engageable with the eccentric portion and moveable between first and second positions in response to rotation of the eccentric portion; and a connecting member extending between the follower and the adjustment mechanism for transmitting a force therebetween.

47. The assembly of claim 46 wherein the connecting member comprises a cable.

48. The assembly of claim 46 wherein the eccentric portion comprises a notched cylindrical portion.

49. The assembly of claim 46 wherein the follower comprises a coupling ring.

50. The assembly of claim 46 wherein the component comprises a handle bar.

51. The assembly of claim 46 wherein the exercise machine comprises a weight lifting machine.

52. An exercise machine, comprising:

an adjustably positionable component;

a load operatively coupled to the component;

an adjustment mechanism coupled to the component and having a locking member releasably engageable with a fixed member, the component being moveable when the locking member is disengaged from the fixed member; and an actuating assembly including:

a shaft rotatably mounted to a portion of the exercise machine for access by a user of the exercise machine, the shaft having an eccentric portion;

a lever connected to the shaft for transmitting a rotational force thereto;

a follower engageable with the eccentric portion and moveable between first and second positions in response to rotation of the eccentric portion; and a connecting member extending between the follower and the adjustment mechanism for transmitting a force therebetween.

53. The exercise machine of claim 52 wherein the connecting member comprises a cable.

54. The exercise machine of claim 52 wherein the eccentric portion comprises a notched cylindrical portion.

55. The exercise machine of claim 52 wherein the follower comprises a coupling ring.

56. The exercise machine of claim 52 wherein the component comprises a handle bar.

57. The exercise machine of claim 52 wherein the load is operatively coupled to the component by a cable-and-pulley device.

58. The exercise machine of claim 52 wherein the load comprises a weight stack.

59. The assembly of claim 1 wherein the shaft is rotatable in a forward direction and in aft direction.

* * * * *